United States Patent [19]

Nixon et al.

[11] Patent Number: 4,906,127

[45] Date of Patent: Mar. 6, 1990

[54] STRUCTURE CLAMP

[76] Inventors: Franklin H. Nixon, Site 11, Compartment 2, South Slocan, British Columbia, Canada, V0G 2G0; Anthony F. Quance, 12534 Industrial Ave., Surrey, British Columbia, Canada, V3V 3S5

[21] Appl. No.: 246,216

[22] Filed: Sep. 19, 1988

[30] Foreign Application Priority Data

Mar. 21, 1988 [CA] Canada ..... 561960

[51] Int. Cl.[4] ..... E04G 7/00

[52] U.S. Cl. ..... 403/385; 24/459; 403/399; 403/400

[58] Field of Search ..... 403/385, 399, 310, 311, 403/331, 400; 24/459, 19, 268, 136 R, 115 M

[56] References Cited

U.S. PATENT DOCUMENTS

| | | | |
|---|---|---|---|
| 1,383,451 | 7/1921 | Dalrymple | 403/311 X |
| 1,566,953 | 12/1925 | Becker | 24/268 X |
| 2,424,542 | 7/1947 | Adams, Jr. | 24/268 |

FOREIGN PATENT DOCUMENTS

| | | | |
|---|---|---|---|
| 812364 | 8/1951 | Fed. Rep. of Germany | 403/385 |
| 1401259 | 4/1965 | France | 403/385 |
| 2537223 | 6/1984 | France | 403/385 |
| 412493 | 12/1945 | Italy | 403/385 |
| 429500 | 1/1948 | Italy | 403/385 |

*Primary Examiner*—James R. Brittain

*Attorney, Agent, or Firm*—Wells, St. John & Roberts

[57] ABSTRACT

A clamp for securing adjacent sides of a pair of structural members such as metal tubing. The clamp comprises of a pair of fastening devices joined together, back to back. Each fastening device further comprises an inwardly contactible sleeve with the back side being flat where it is joined. From the backside two sides are turned to enclose a structural member and form an opening to facilitate entry of the structural member. At opposite sides of the opening a pair of wedge flanges are turned outwardly with diverging tapers. Each sleeve has a contractor with inturned flanges which taper in opposition to the taper of the sleeve flanges. The contractor when slid onto the sleeve flanges draws itself and the sleeve into a constricting gripping engagement with the enclosed structural member.

7 Claims, 2 Drawing Sheets

STRUCTURE CLAMP

BACKGROUND OF THE INVENTION

The present invention relates to a clamp for securing adjacent sides of a pair of longitudinal structural members such as metal tubing.

Various types of clamping or fastening devices of this nature are known.

The most simple is the nut and bolt. Although inexpensive in material this method involves the drilling of holes which is time consuming. If, for example, one wishes to erect a structure out of metal tubing by drilling and bolting, he or she must have some sort of supporting help while bolting the members. Also some form of bracing is required, usually by bolting on diagonal members. A problem can be the misalignment of holes, especially if the structural members come predrilled.

There are available, scaffold clamps. One type of scaffold clamp is very effective. One person can clamp this device to one tube very quickly with a few blows of a hammer, then apply the other tube by the same method and it is done. The scaffold clamps hold the tubing very rigidly so that no diagonal bracing is usually required.

The disadvantages to scaffold clamps are that they are overbuilt and expensive for some uses, for example, light greenhouses. Another disadvantage is that these clamps are limited to only a few sizes. A further disadvantage is that these clamps are bulky and protrude from the structure causing problems with any covering material.

What is desirable are clamps that fit several sizes and shapes of structural material, are build lightly enough but still do the job, are simple and easy to operate, and are inexpensive enough to justify the saving in time realized by their use. The present invention relates to a clamp for more easily and inexpensively securing the adjacent sides of structural members.

SUMMARY OF THE INVENTION

The present invention consists of a clamp for securing adjacent sides of a pair of longitudinal structural members. In one aspect of the invention, the clamp consists of two fastening devices joined together. Each device further consists of an inwardly contractible sleeve with a longitudinal passage. The sleeve has a longitudinal opening to facilitate inward contraction of the sleeve. The sleeve is provided along opposite edges of the opening with wedge flanges that are turned outwardly. These flanges diverge longitudinally from each other to constitute wedge means.

Each sleeve has a contractor with inturned flanges. These flanges are for engaging slidably and substantially the entire length of the wedge flanges of the sleeve. When slid into place the contractor inwardly contracts the sleeve into constricting gripping engagement with the structural member contained within. In the same action the flanges of the sleeve draw the contractor into constricting gripping engagement with the same structural member.

The sleeves are joined together, each on the side opposite the longitudinal opening. The openings of the two sleeves face outwardly from the join.

The sides of the sleeves being joined may be flat to facilitate ease of joining and to produce a stronger more rigid join.

The cross sectional shape of each sleeve is proportioned to contain effectively the structural member contained within the sleeve.

The sides and flanges of each sleeve extend from the joined side around the contained structual member sufficiently short and the contractor curves around the structural member sufficiently to meet the sleeve flange so as to allow inward contraction of the contractor against the structural member.

The shape of the contractor may be outwardly smooth and may conform compactly to the structural member contained within.

In another aspect of the invention, the clamp comprises a pair of fastening devices joined together, back to back. Each device further comprises an inwardly contractible sleeve made form sheet metal. Each sleeve has a back side which is flat for easily and rigidly welding to the other sleeve. This back side is tapered along it's length so that it has a wide end and a narrow end. From the back side, two sides are turned to enclose the structural member, which may be metal tubing. The two sides form a longitudinal opening to facilitate inward contraction of the sleeve and to facilitate easy entry of the metal tubing. At opposite sides of the opening a pair of wedge flanges are turned outwardly more than 90°. These flanges are tapered, not in thickness but in width along their length. This is to constitute means for a wedging action. The taper of the flanges taper oppositely to the taper of the back side of the sleeve.

In this aspect, the clamp also comprises a sleeve contractor for each sleeve. The contractor is made from sheet metal and formed to curve partially over the metal tube contained within the sleeve. The contractor has inturned flanges along its longitudinal edges. The flanges are tapered in width along their length in opposition to the taper of the sleeve flanges. This allows a matching engagement. The contractor when slid onto the sleeve flanges constitutes a contracting action on the sleeve. In the same action the sleeve flanges draw the contractor toward the back of the sleeve. This results in a constricting gripping engagement with the metal tube. The contractor is outwardly smooth and conforms to the metal tube sufficiently so as not to interfere with any covering material over the structure.

BRIEF DESCRIPTION OF THE DRAWINGS

The invention, as exemplified by a preferred embodiment, is described with reference to the drawings in which.

DETAILED DESCRIPTION OF THE INVENTION

Figure 1:
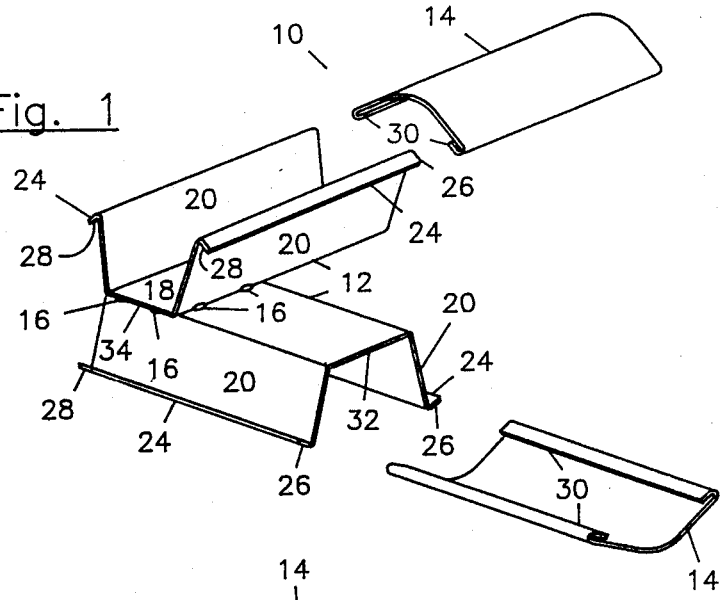
FIG. 1 is an exploded perspective view of an embodiment of a structure clamp of the invention.

Referring to the drawings, the embodiment of the invention shown, a structure clamp 10 comprises two sleeves 12 and two sleeve contractors 14, one for each sleeve.

Figure 2:
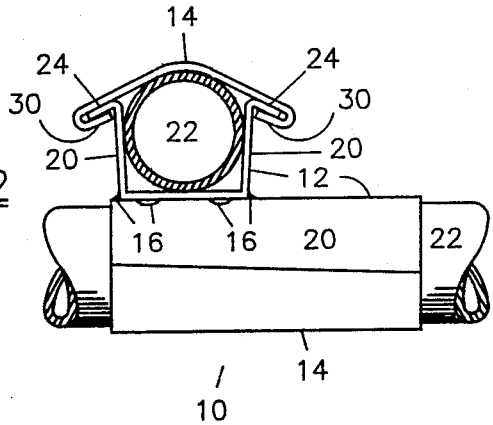
FIG. 2 is a view of the structure clamp shown in FIG. 1, showing the end of one part of the clamp and the side of the other, each part enclosing a section of metal tubing.

The sleeves are joined together, back to back at 90° to each other, as shown in FIG. 1 and FIG. 2. This join may be done by welding. The welds 16 may be done is stitches around the contacting edges of the two sleeves. The ack of each sleeve 18 is flat to facilitate simpler welds and give better rigidity to the two sleeves.

As may be seen in FIG. 2, from the back of each sleeve two sides 20 are turned to enclose a structural member, in this example, metal tubing 22. These sides thus form a longitudinal opening through which the metal tube can be inserted.

Figure 3:
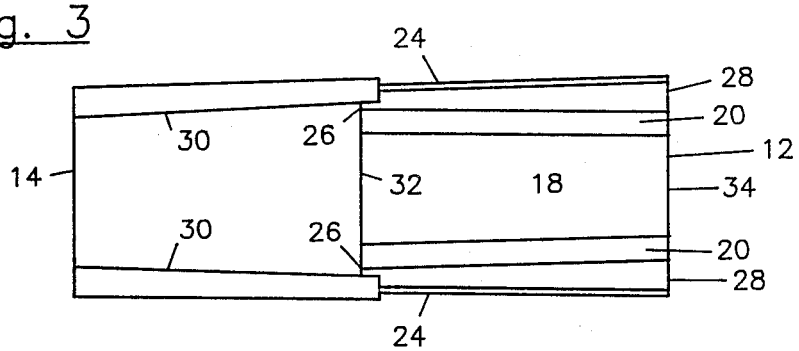
FIG. 3 is a view of one part of the structure clamp shown in FIG. 1 and FIG. 2, showing the back side of the sleeve and a view of the inner side of the sleeve contractor, the contractor shown as partly entering onto the flanges of the sleeve.

As may be seen in FIG. 1 and FIG. 2, at opposite sides of the longitudinal opening the sides of each sleeve have wedge flanges 24 turned outwardly more that 90°. As best seen in FIG. 3, these flanges are tapered slightly from one end to the other, not in thickness of material but in the width of the flanges. The result is a means for a wedging action with the narrow end 26 and the wide end 28 being shown.

Each sleeve contractor 14 is slightly curved over the metal tube, as shown in FIG. 2. Each contractor has inturned flanges 30 along it's longitudinal edges. These flanges are similarly but oppositely tapered to the sleeve flanges for a matching engagement. When the contractor is slid onto the sleeve flanges and driven the full length, an inward contracting action is attained on the sleeve. Because the wedge flanges on the sleeve are turned more than 90°, because the sides of the sleeve are sufficiently short and because the contractor is curved over the metal tube, a resulting contraction on the metal tube is obtained by the contractor. The contractor may be outwardly smooth.

As best shown in FIG. 3, the back side of each sleeve 18 may be longitudinally tapered slightly with the wide end 32 and the narrow end 34. This taper is of a size to allow the metal tube when placed inside the sleeve to attain contact with the back at the wide end but not quite attain contact with the back at the narrow end. Because the wide end of the sleeve is also the same end that the contractor goes on, easy entry of the contractor onto the flanges of the sleeve is achieved. As the contractor is driven onto the sleeve the whole back of the sleeve is drawn firmly to the metal tube. The sides of the sleeve at the narrow end are drawn securely around the tube in a strong gripping action.

The reason for tapering the back of the sleeve instead of the sides is that when the sides are tapered, the contractor, when driven onto the sleeve, does not conform closely to the metal tube, instead, leaving a slight gap at the same end as the wide end of the sleeve.

The structure clamp of this invention is preferably made of a sufficiently heavy gauge of sheet metal which can be pressed or folded. Such material is sufficiently strong and flexible. However, such clamps may be made of other materials having suitable properties. Certain plastics or molded aluminum may be suitable.

The sleeves, of the structure clamp of this invention, are preferably joined back to back at 90°. For other purposes the sleeves may be joined at any other angle. The sleeves may further be joined so as to swivel.

Figure 4:
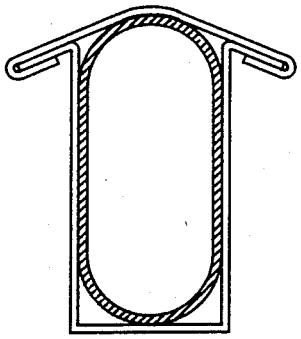
FIG. 4 is an end view of one part of another structure clamp embodying the invention.
Figure 5:
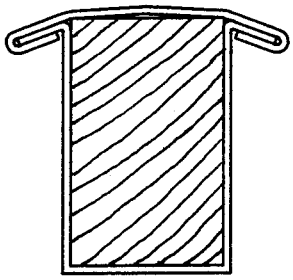
FIG. 5 is an end view of one part of another structure clamp embodying the invention.
Figure 6:
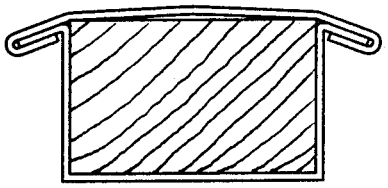
FIG. 6 is an end view of one part of another structure clamp embodying the invention.

As shown in FIG. 4, and FIG. 5, and FIG. 6, the structure clamp of this invention may be manufactured in various sizes and shapes to suit the respective sizes and shapes of various structural members. Two structural members of different size or shape can be secured by a suitable clamp.

One feature of the structure clamp of this invention is that, because the contractor is outwardly smooth and because it is curved to conform closely to the metal tube, the outward surfaces of the structural clamp will give little interference with the placement of any covering material over the structure. If the covering material is a tarpaulin, or the like, there is reasonably little chance of chafing.

Another feature of the structure clamp of this invention is the stability it imparts to the structure. For the type of structures this clamp is intended the cumulative rigidity of each clamp adds up to a total stability. Ordinarily no diagonal bracing is required.

A further feature of the structure clamp of this invention is its ability to secure structural members together and disassemble them in simple swift actions. To assemble two structural members the sleeve is placed over one member with the other sleeve facing in the desired direction. The sleeve contractor is slid on and driven part way with a hammer. The other member is then placed in the other sleeve and its contractor driven part way. When satisfied with the alignment both contractors are driven home.

Disassembly requires only to drive off the contractors.

A disadvantage of the structure clamp of this invention is that appropriate sizes must be manufactured for each size and shape of structural material. Also if the structural members are desired to be rigidly held at special angles then the sleeves would have to be joined at these angles.

Although only a single embodiment of the present invention has been described and illustrated, the present invention is not limited to the features of this embodiment, but includes all variations and modifications within the scope of the claims.

We claim:

1. A clamp securing to one another, adjacent sides of a pair of longitudinal structural members, comprising of a pair of fastening devices joined one to the other each device further comprising:

an inwardly contractible sleeve having a longitudinal opening tapering the full length of the sleeve from a wide end to a narrow end to facilitate entry of at least one structural member and to facilitate inward contraction of the sleeve, the sleeve being provided along opposite edges of the opening with wedge flanges that are outwardly turned and which diverge longitudinally from one each other in a taper opposite to the taper of the longitudinal opening to constitute wedge means; and a contractor, for each sleeve, having inturned flanges for engaging slidably and substantially the entire length of the wedge flanges of the sleeve and for inwardly contracting the sleeve into constricting gripping engagement with the structural member contained therein, while in the same action the flanges of the sleeve drawing the contractor into constricting gripping engagement with the same structural member.

2. A claim as claimed in claim 1, wherein the sleeves are joined one to the other, each on a longitudinal side opposite the longitudinal opening, so that the openings are facing outwardly from the joint.

3. A clamp as claimed in claim 2, wherein the longitudinal side opposite the longitudinal opening is flat to facilitate ease of joining and to produce a strong rigid joint.

4. A clamp as claimed in claim 2 wherein the sides and flanges of each sleeve extend from the joined side and the contractor curves sufficiently to meet the sleeve flanges so as to allow inward contraction of the contractor against the structural member.

5. A clamp as claimed in claim 4, wherein the contractor includes an outward smooth surface and an opposed inward surface that is adapted to conform compactly to the structural member to be contained therein.

6. A clamp as claimed in claim 1 wherein the cross section shape of each sleeve is proportioned to contain effectively the structural member contained therein.

7. A clamp for securing to one another adjacent sides of a pair of elongated structural members, comprising a pair of fastening devices joined one to the other, back to back, each device further comprising:

an inwardly contractible elongated sleeve having a back side which is flat to facilitate attachment to the other sleeve, the back side being tapered longitudinally along the sleeve, being wide at one sleeve end and narrow at the other sleeve end;

from the back side, two sides turned to form a longitudinal opening, to facilitate inward contraction of the sleeve and to facilitate easy entry of the structural member;

at opposite sides of the longitudinal opening a pair of wedge flanges turned outwardly, the flanges being tapered, not in thickness, but in width longitudinally to constitute means for a wedging action, the taper of the flanges tapering oppositely to the taper of the back side of the sleeve; and an elongated sleeve contractor having inturned flanges along its longitudinal edges, the contractor upon sliding onto the sleeve flanges, imparting a contracting action on the sleeve while in the same action the sleeve flanges drawing the contractor inwardly against the structural member resulting in a constricting gripping engagement thereof.

* * * * *